US008427721B2

(12) United States Patent
Vinkenvleugel et al.

(10) Patent No.: US 8,427,721 B2
(45) Date of Patent: Apr. 23, 2013

(54) DEVICE AND METHOD FOR DYNAMICALLY CHANGING COLOR

(75) Inventors: Lucius Theodorus Vinkenvleugel, Eindhoven (NL); Johannes Petrus Wilhelmus Baaijens, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 528 days.

(21) Appl. No.: 12/673,038

(22) PCT Filed: Aug. 14, 2008

(86) PCT No.: PCT/IB2008/053263

§ 371 (c)(1),
(2), (4) Date: Feb. 11, 2010

(87) PCT Pub. No.: WO2009/024903

PCT Pub. Date: Feb. 26, 2009

(65) Prior Publication Data

US 2012/0119670 A1 May 17, 2012

(30) Foreign Application Priority Data

Aug. 17, 2007 (EP) ..... 07114554

(51) Int. Cl.
*G03F 3/08* (2006.01)
*F21S 2/00* (2006.01)

(52) U.S. Cl.
USPC ..... 358/520; 315/291

(58) Field of Classification Search ..... 315/291, 315/307, 224, 292, 293, 297, 308, 362, 363; 362/230, 231; 345/204, 690, 22; 358/518, 358/520
See application file for complete search history.

(56) References Cited

U.S. PATENT DOCUMENTS

| | | | | |
|---|---|---|---|---|
| 6,351,557 | B1 | 2/2002 | Gonsalves | |
| 7,310,443 | B1 | 12/2007 | Kris et al. | |
| 7,626,345 | B2 * | 12/2009 | Young | 315/307 |
| 7,710,369 | B2 * | 5/2010 | Dowling | 345/83 |
| 2009/0168415 | A1 * | 7/2009 | Franciscus Deurenberg et al. | 362/233 |

FOREIGN PATENT DOCUMENTS

| | | | |
|---|---|---|---|
| EP | 1113709 | A2 | 7/2001 |
| JP | 3032162 | A | 2/1991 |
| JP | 8154168 | A | 6/1996 |
| JP | 2004064198 | A | 2/2004 |
| WO | 20060569578 | A2 | 6/2006 |

* cited by examiner

*Primary Examiner* — Minh D A
(74) *Attorney, Agent, or Firm* — John F. Salazar; Mark L. Beloborodov

(57) ABSTRACT

A lighting system (900) has a light source (920) configured to provide a light, and a controller (930) configured to control hue and saturation of the light to change a color of the light from an initial color to a final color during at least two phases.

11 Claims, 14 Drawing Sheets

DEVICE AND METHOD FOR DYNAMICALLY CHANGING COLOR

The present invention relates to a device and method to dynamically change the color of light emanating from a light source from one color to another color in a well-perceived manner, based on changing hue and/or saturation, in accordance with predetermined relationships.

Lighting systems are increasingly being used to provide an enriching experience and improve productivity, safety, efficiency and relaxation. Light systems are becoming more advanced, flexible and integrated. This holds especially for professional domains like the retail domain, but new lights or light systems will also enter the home domain. This change is stimulated by the advent of LED lighting (Light Emitting Diodes or Solid State lighting). It is expected that LED lighting systems will proliferate due to increased efficiency as compared to today's common light sources, as well as to the ease of providing light of changeable color.

Advanced lighting sources and systems are able to provide light of desired attributes, such as projecting a color to a wall or to a corner of a room, where the color is dynamically changed in time, for example, from one color to another color.

The inventor has learned that in some occasion users would like to change colors in time, for example from one preferred color to another. It was also learned that people do not prefer or even dislike certain colors. This means that using a normal-used "edge" of the color gamut is not a good method to change colors. For example, when changing colors from Yellow to Cyan, if a hue-color triangle is followed, then one will pass the Green Color. When a user dislikes the pure Green color, then such a method of changing colors is not desirable.

Furthermore it is observed that people do not like the white color as an in-between or a transition color when changing from one color to another. The purpose of a color-changing lamp is to make colors, and white is often not perceived as a color, or white is disliked and therefore should be avoided. One way to change colors is to linearly interpolate between the Red, Green and Blue (RGB) values of first color to the RGB values of a second color, such as by following the dotted line 340 from initial color of red to final color of green shown in FIG. 3, for example. That is, a color change is achieved by following a linear path that connects two endpoints colors, namely, a starting color and a destination (or desired) color. However, such a method may lead to situations where disliked colors (e.g., a white color) are obtained. FIG. 1 shows an example of a linear interpolation method 100 for changing colors from Red, shown as the left intensity axis 110 to Blue shown as the right intensity axis 120, moving upward from minimum intensity to maximum intensity. The color change occurs over time as shown by the horizontal axis 130.

When linearly interpolating the RGB values (in this case from R to B), one will get Magenta color in between as shown by reference numeral 540 in FIG. 5. If a user does not like this pure Magenta color, then this linear interpolation method 100 is not a good method to change colors.

Accordingly, there is a need for simple light control systems that control light sources to change the light color from one desired color to another desired color in a pleasing way, such as avoiding undesirable light attributes, e.g., avoiding or minimizing light emissions of a particular color such as white.

One object of the present systems and methods is to overcome the disadvantages of conventional control systems.

According to one illustrative embodiment, a lighting system comprises a light source, and a controller configured to control hue and/or saturation of the light to change a color of the light from an initial color to a final color during at least two phases. The systems and methods allow dynamically changing the color from one color to another color in a well-perceived manner, without using colors that users dislike, and/or without using a white color setting.

Further areas of applicability of the present devices, systems and methods will become apparent from the detailed description provided hereinafter. It should be understood that the detailed description and specific examples, while indicating exemplary embodiments of the systems and methods, are intended for purposes of illustration only and are not intended to limit the scope of the invention.

These and other features, aspects, and advantages of the apparatus, systems and methods of the present invention will become better understood from the following description, appended claims, and accompanying drawing where:

The following description of certain exemplary embodiments is merely exemplary in nature and is in no way intended to limit the invention, its applications, or uses. In the following detailed description of embodiments of the present systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

Figure 1:
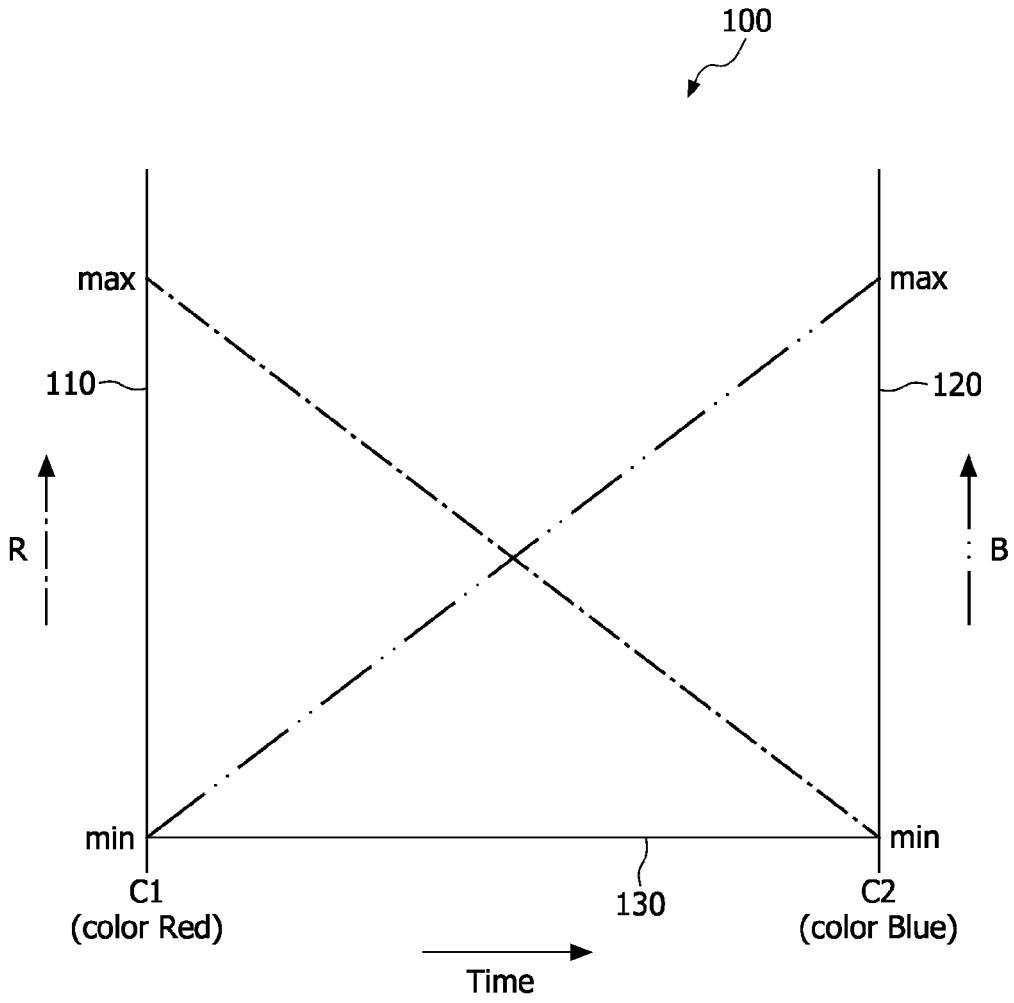
FIG. 1 shows a conventional method to change the color of a light.
Figure 2:
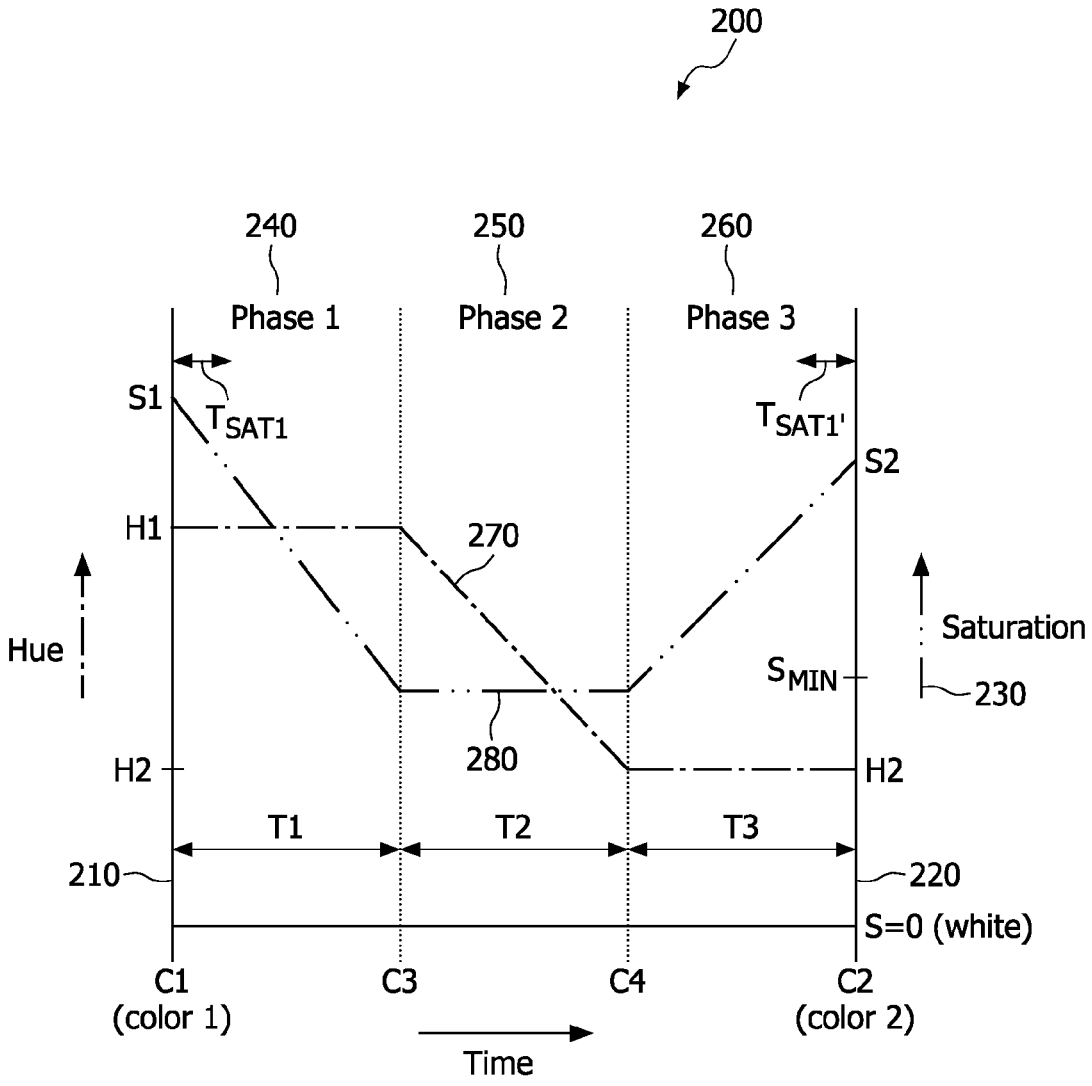
FIG. 2 shows a three-phased method according to one embodiment.

FIG. 2 shows a three-phased method 200 to dynamically change colors, according to one illustrative embodiment, using Hue and Saturation as parameters for the color setting, where a color point C is associated with a hue value H and a saturation level S. FIG. 2 shows how to change the colors dynamically between color 1 or C1, defined with parameters hue H1 and saturation S1, to color 2 or C2, defined with parameters hue H2 and saturation S2. As shown in FIG. 2, the left axis 210 may be the hue axis having different values of hue, and the right axis 220 may be the saturation axis having different levels of saturation. In particular, different colors or hue values are provided along the hue axis 210, such as a first hue value H1 associated with a first color 1 or C1, and a second hue value H2 associated with a second color 2 or C2. Saturation values increase along the saturation axis 220 in the upper direction shown by arrow 230.

The method includes controlling the hue and saturation values in predetermined relations with each other during a plurality of phases of equal or different time durations, such as three phases, along predefined paths to change color and/or saturation of light emanating from a controllable light source 920 (shown in FIG. 9) in a manner pleasing and desirable to users, viewers and observers. The following embodiments describe various methods and systems to change the light color from an initial to a final color using three phases. In particular, the initial color C1 is changed to a first intermediate color C3 in phase 1, which is then changed to a second intermediate color C4 in phase 2, which in turn is changed to a final or desired color C2 in phase 3. Of course, it should be understood that any number of phases may be used in addition to or instead of using three phases.

In the embodiment shown in FIG. 2, the method 200 includes controlling the hue values (e.g., changing the color) of the light from the controllable light source 920 (shown in FIG. 9) in three phases 240, 250, 260 which may have substantially the same time duration T1, T2, T3. Alternatively, time duration T2 of the second phase 2 may be greater or less then the time durations T1, T3 of the first and third phases 1, 3, respectively, where T1 may be substantially equal to T3.

The method 200 of this embodiment includes controlling the hue values along a hue graph 270 shown as a dashed line where dashes are separated by a single dot, while simultaneously controlling the saturation values along a saturation graph 280 shown as a dashed line where dashes are separated by two dots. It should be noted that brightness is not essential because it is a parameter that expresses the light output, and is not related to color.

As shown in FIG. 2, in the first phase 240, the hue is kept constant at level H1, as seen from the hue graph 270, and the saturation is changed from an initial value S1 to a lower intermediate value SMIN along the saturation graph 280. It should be noted that the saturation does not go to zero, which is the white point. The minimum value for saturation may be from 40% to 70% of the maximum value, e.g., of the initial value S1. In the second phase 250, the saturation graph 280 is kept constant at the intermediate value $S_{MIN}$ while the hue value is changed from the initial hue value H1 to a different or desired hue value H2. At the end of the first phase 240 or beginning of the second phase 250, the color is changed from C1 to C3, where color is associated with hue and saturation values. That is, the initial color C1, having hue and saturation values of H1, S1, is changed to the first intermediate color C3 having hue and saturation values of H1, $S_{MIN}$. Thus, in the first phase 240, the saturation of the initial light emanating from the controllable light source 920 is reduced to SMIN without changing the hue value H1 to result in the first intermediate color C3; and in the second phase 250, the hue value is changed to the final or desired value H2 without changing the saturation value SMIN to result in the second intermediate color C4.

In the third phase 260, the hue value, namely, the final value H2, is kept constant and the saturation value is changed, namely, increased from the reduced value SMIN to the desired or final value S2, which may be the substantially same or different from the initial values S1, to result in a final or desired color C2 having the final hue and saturation values of H2, S2. It should be noted that the intermediate value SMIN is the minimum value as compared to the initial and/or the final saturation values S1, S2, so that the third phase 260 includes an increase (instead of a decrease, for example,) of the saturation value from the intermediate value SMIN to the final saturation value S2.

With this method, disliked colors and the white color setting may be minimized or prevented because they are saturated (with a saturation value of SMIN which is) much less than the initial and final saturation values S1, S2. Thus, the white and/or disliked colors are not substantially visible or noticeable to the user. Such a method is more user-friendly and desirable as compared to a method that does not reduce the saturation, or a method that changes the color via the white color point.

Figure 3:
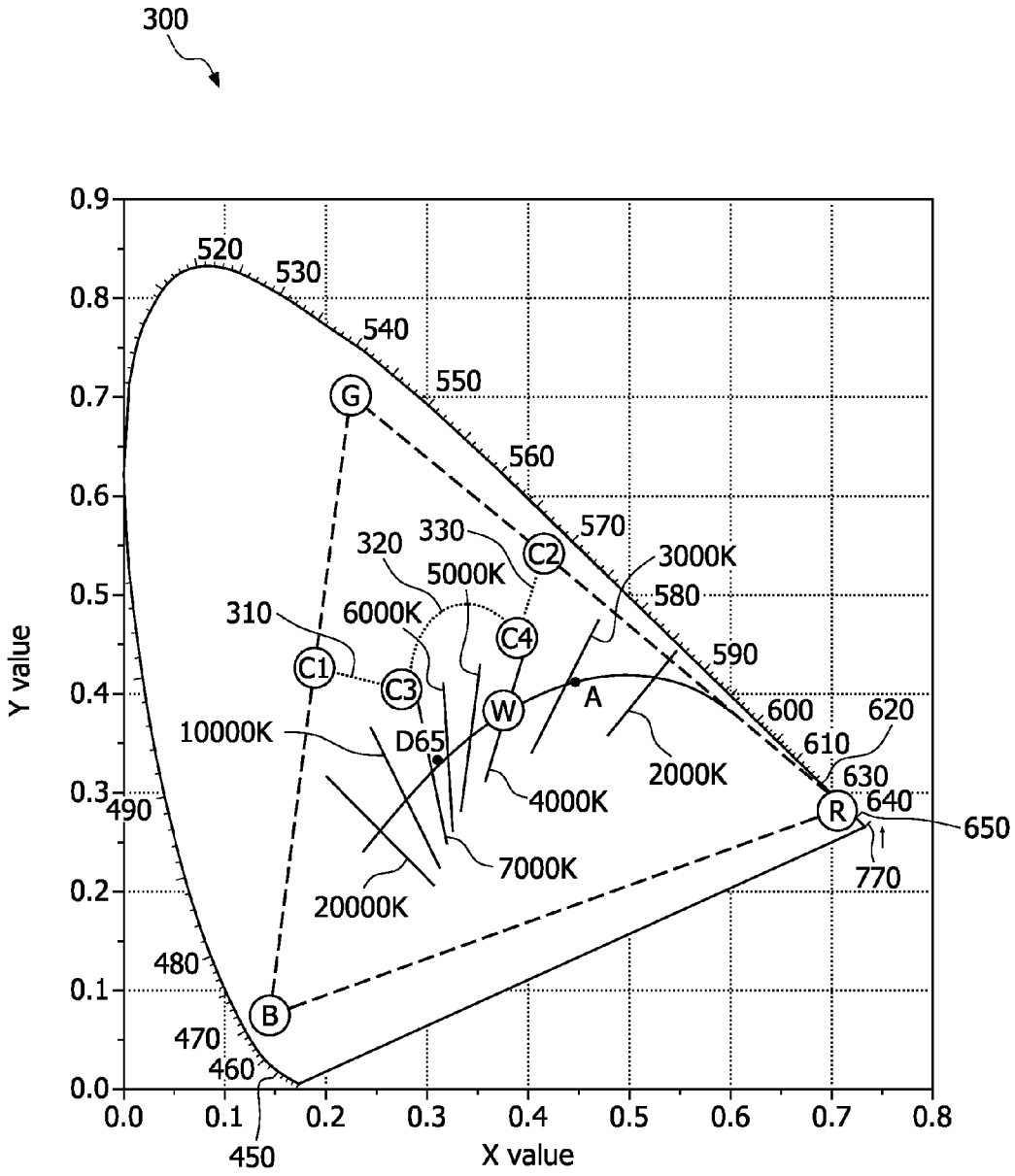
FIG. 3 shows an illustrative example of a color coordinate system according to one embodiment.
Figure 9:
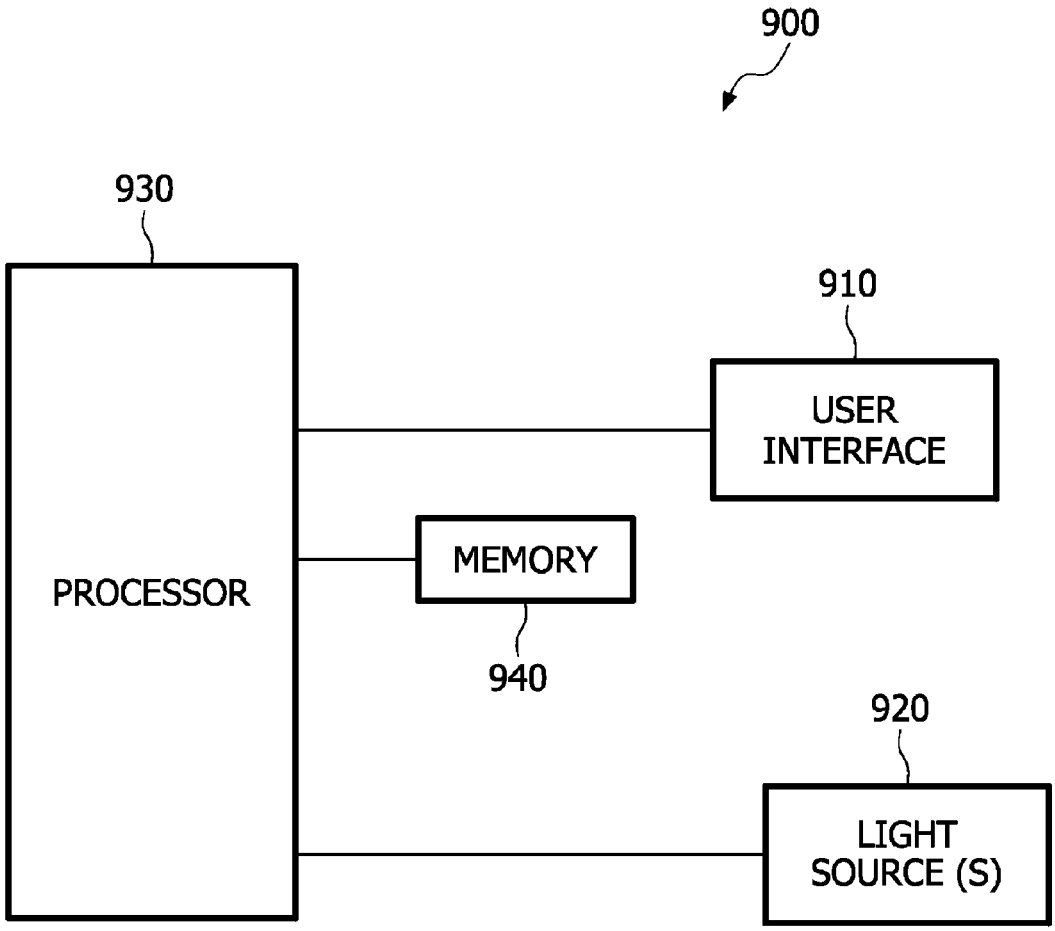
FIG. 9 shows a block diagram of a control system according to a further embodiment.

FIG. 3 shows an illustrative example of a color coordinate system 300 where the three primary colors, Red (R), Green (G) and Blue (B) are shown as corners of a dashed triangle of the color coordinate system 300. As shown by the dotted lines in FIG. 3, a controller 930 shown in FIG. 9 is configured to change the color of light from the controllable light source 920 from an initial cyan-turquoise like color C1 to a final lime-yellow color C2. The controller 930 is configured to change the light from the initial color C1 to the first intermediary color C3 along path 310 in Phase 1 (shown as reference numeral 240 in FIG. 2). In phase 2 (250 of FIG. 2), the controller 930 is configured to change the light from the first intermediary color C3 to the second intermediary color C4; and in phase 3 (260 of FIG. 2), the controller 930 is configured to change the light from the second intermediary color C4 to the final color C2. It should be noted that the pure Green color G (e.g., a disliked color) and the white point W are avoided, where the white point W shown in FIG. 3 is substantially on or near a blackbody line.

Figure 4A:
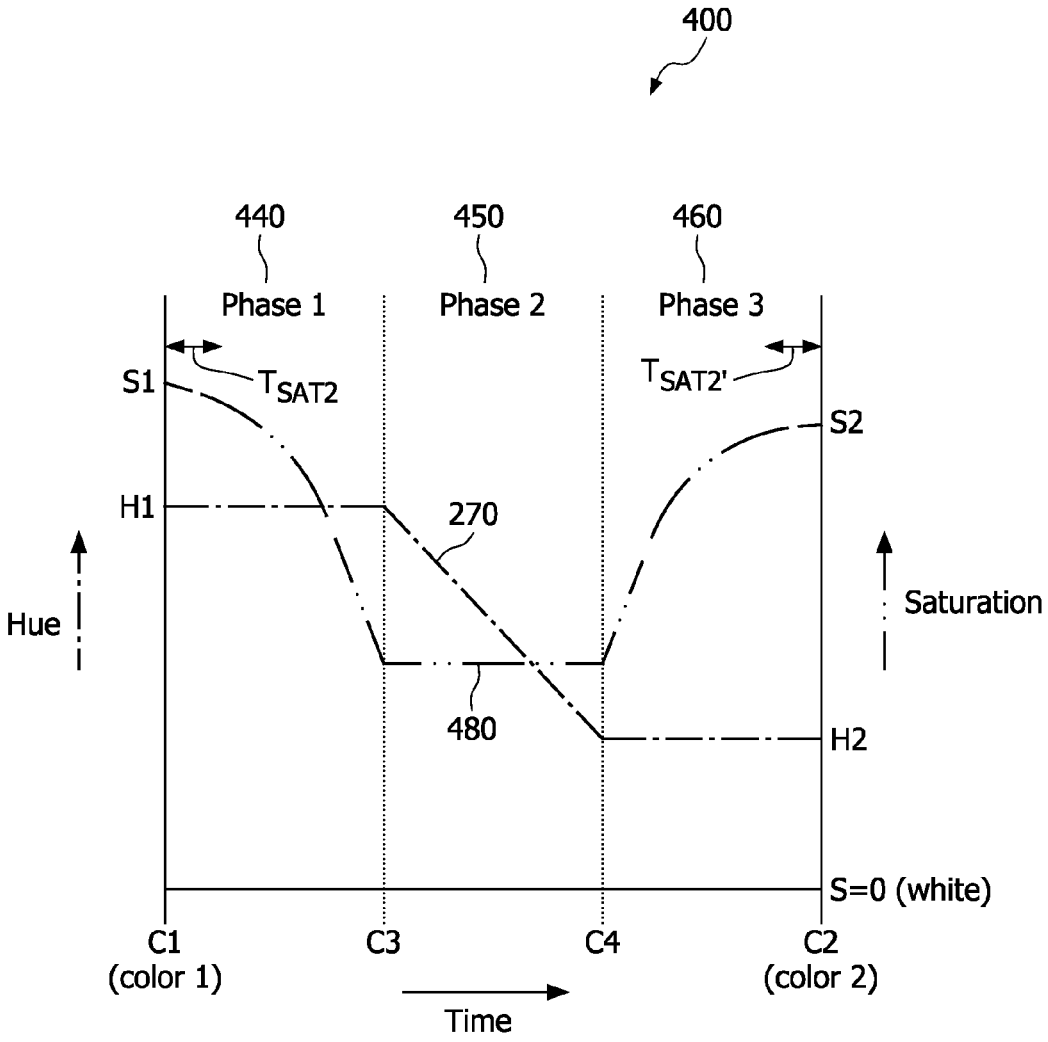
FIGS. 4A-4B show three-phased methods according to further embodiments.

FIG. 4A, shows a method 400 which is variation on the method 200 show in FIG. 2. The method 400 shown in FIG. 4A, also includes three phases 440, 450, 460 where the controller 930 is configured to simultaneously control the hue and saturation of light from the light source 920, along the hue curve 270 and the saturation curve 480, respectively. The hue curve 270 is similar to the one shown in FIG. 2, but the saturation path or curve 480 is different from its counterpart 280 shown in FIG. 2. In particular, the controller 930 is configured to slowly change the saturation of the light emanating from the controllable light source 920 near the initial and final colors C1 and C2, and to change the saturation faster near intermediate colors C3 and C4, where the slopes of the saturation curve 480 near the intermediary colors C3, C4 are steeper (e.g., more positive or more negative), than the slopes near the end points, or initial and final colors C1, C2.

This method 400 is sometimes preferred because users often prefer the more saturated colors, and in this method 400, the dynamically changing color stays a larger part of the time near the higher saturated colors C1 and C2. That it, the time periods TSAT2, TSAT2' where the colors are highly saturated is greater in the method 400 shown in FIG. 4, as compared to TSAT1, TSAT1' in the method 200 of FIG. 2.

Figure 4B:
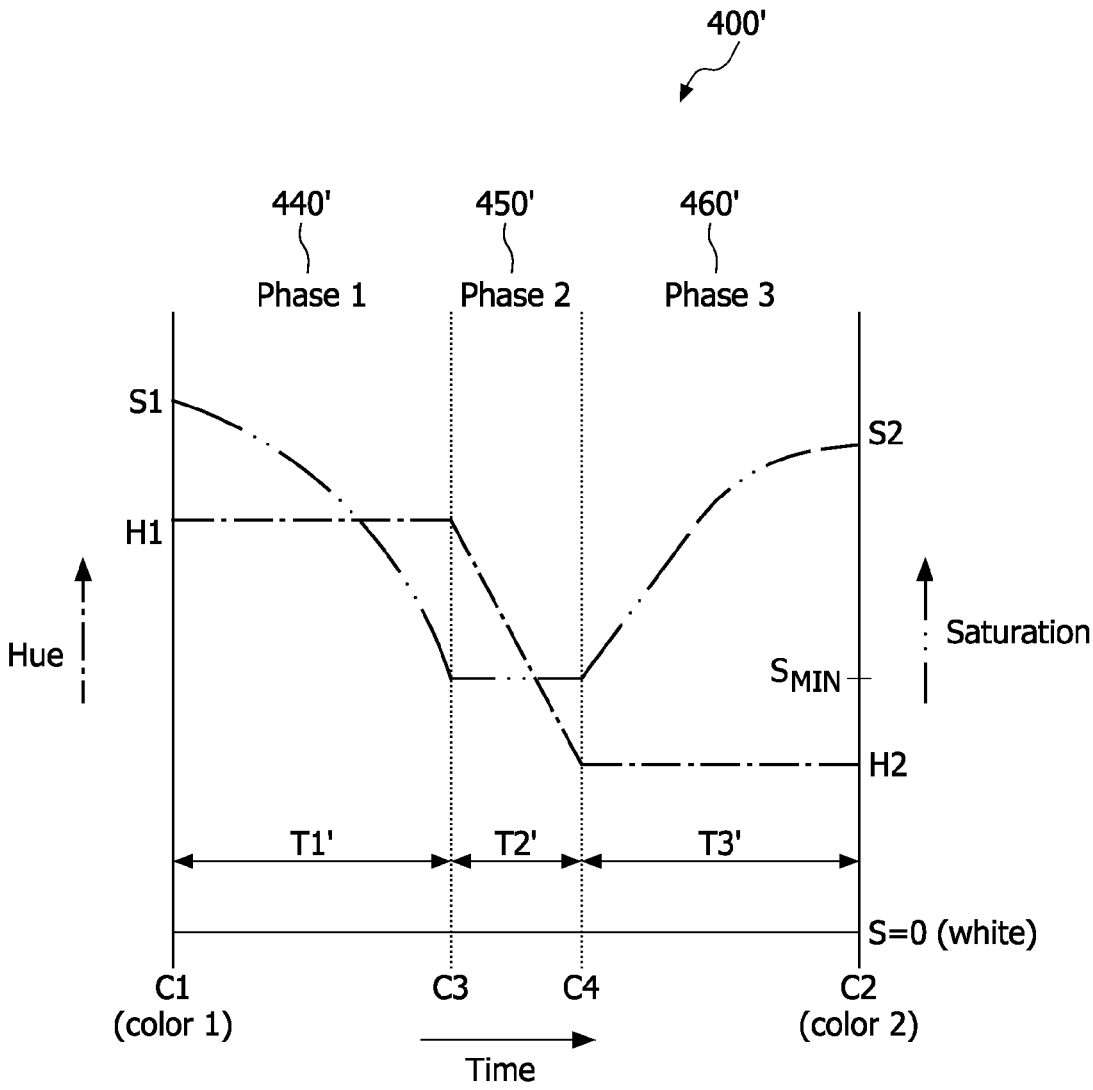

Another variation is to make the time period of phase 2 much shorter, as shown in the method 400' of FIG. 4B, where the time period T2' of the second phase 450' is substantially less than the time periods T1', T3' of first and last phases 440', 460'. The first and last phases T1', T3' may be substantially equal. In the method 400', hue changes much faster due to the short duration of the second phase time period T2' however, because the saturation during the second phase 450' is at a lower value SMIN, this faster hue change is not perceived as being too fast.

Figure 5:
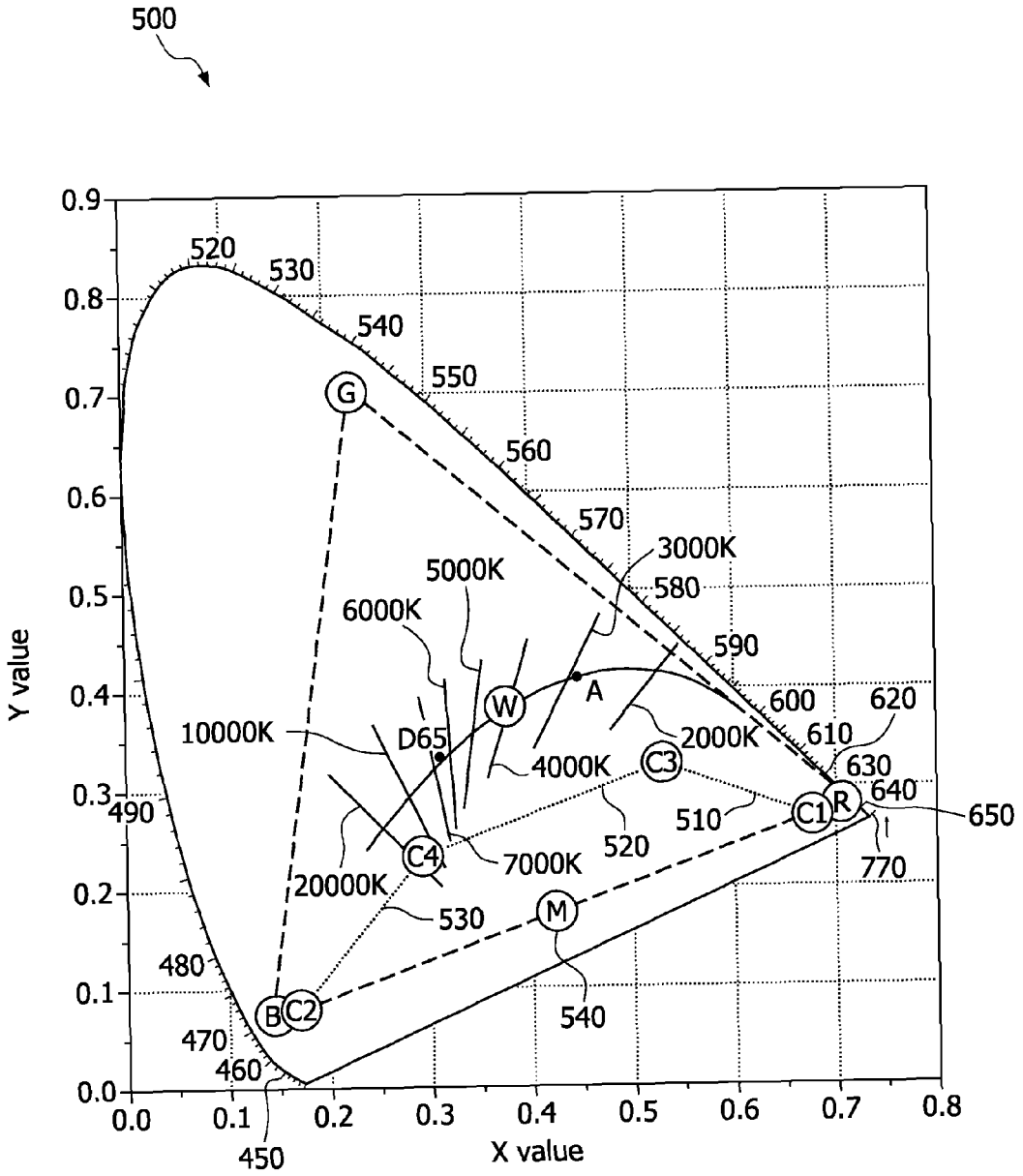
FIG. 5 shows another illustrative example of a color coordinate system according to an embodiment.

FIG. 5 shows a color diagram or coordinate system 500 of the method 400' shown in FIG. 4B for an illustrative example of changing colors from an initial color C1 of Red to Blue (i.e., final color C2). The color change will look follow the dotted paths 510, 520, 530 during the three phases 440', 450', 460', respectively. That is, a disliked color such as pure Magenta M 540 (in the direct path between initial and final colors C1 Red and C2 Blue) is prevented, and the time T2' (FIG. 4B) between the intermediate colors C3, C4, where the light is in the less saturated Magenta color, is minimized.

Figure 6:
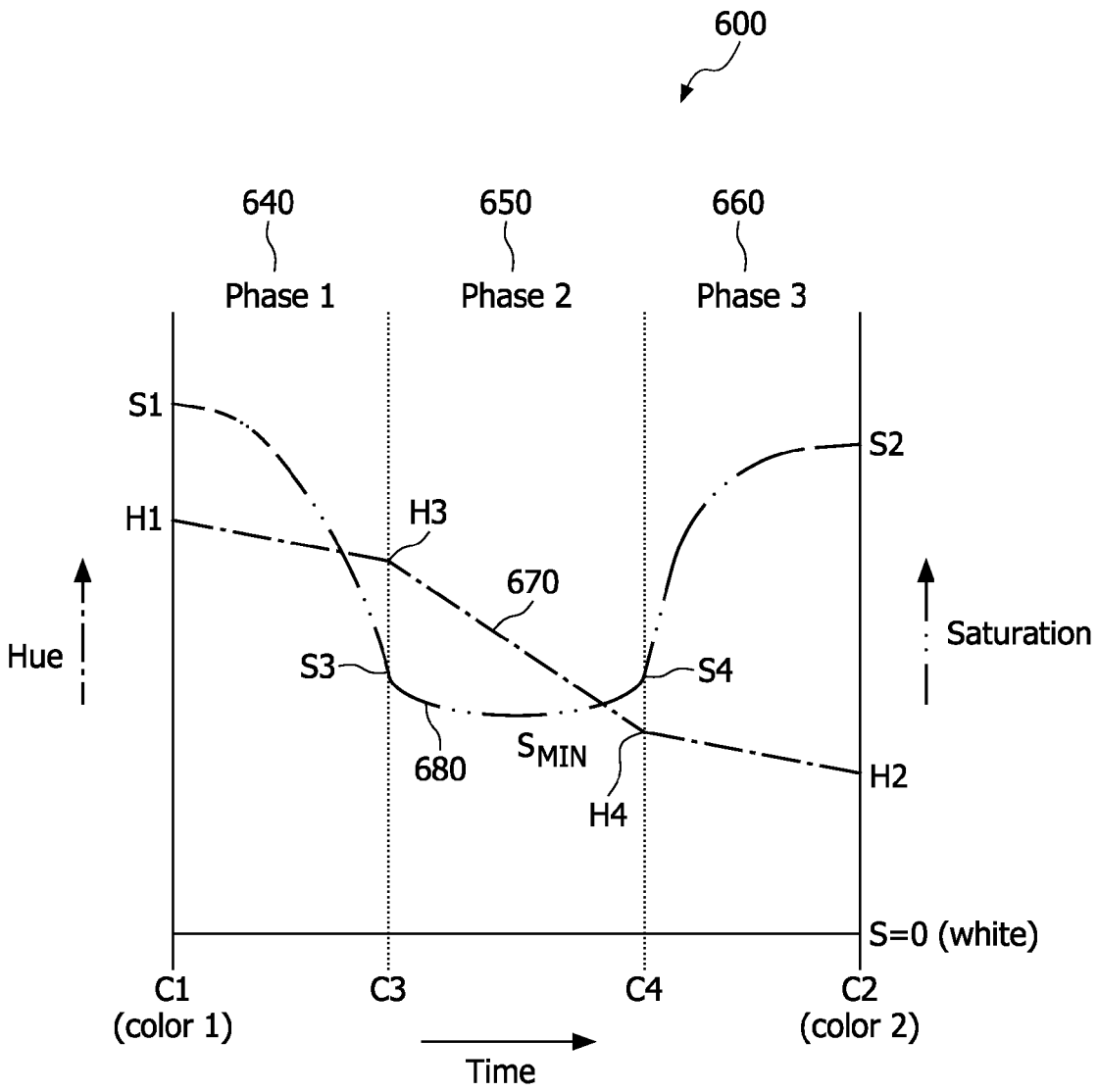
FIG. 6 shows a three-phased method according to another embodiment.

FIG. 6 shows yet another method 600 where constant values for both the hue and saturation are prevented. That is, both the hue and saturation are always dynamically and simultaneously changed during the transition from the initial and to the final color. In particular, during the first phase 640, hue is slightly changed from the initial value of H1 to a first intermediate value H3, and the saturation is substantially changed from an initial value S1 to a first intermediate value S3. As shown in FIG. 6, the rate of change of the hue curve 670 is relatively constant and low (constant and relatively flat or small slope) as compared to the overall rate of change of the saturation curve 680, which is varied and starts by slowly changing near the initial color C1 and changes faster (steep slope) towards the first intermediate color C3.

During the second phase 650, hue is substantially changed from the first intermediate value H3 to a second intermediate value H4, and the saturation is varied slowly from the first intermediate value S3 to a lower value SMIN and then increased back up to a second intermediate value S4. The first and second intermediate values S3, S4 may be the same or different values. During the third phase 660, the hue value is slowly changed (relatively flat or small slop) from the second intermediate value H4 to the final value H2, while simultaneously the saturation value is initially increased at a fast rate (large or steep slope) and then at a slower rate from the second saturation intermediate value S4 to the final saturation value S2.

As shown in FIG. 6, the rate of change of the hue curve 670 in the first and third phases 640, 660 is relatively constant and low (i.e., relatively flat or small slope) as compared to the overall rate of change of the saturation curve 680, which is varied and starts by slowly changing near the initial color C1 and changes fast (steep slope) towards the first intermediate color C3. In the second phase 650, the rate of change of the hue curve 670 is still substantially constant but is higher (i.e., steeper slope) than the rate of change during the first and third phases 640, 660.

The following is a summary of this method 600 shown in FIG. 6:

(a) in the first phase 640, the Hue changes little and the Saturation changes fast;

(b) in the second phase 650, the Saturation changes little and the Hue changes fast; and (c) in the third phase 660, the Hue again changes little and the Saturation changes fast.

Figure 7:
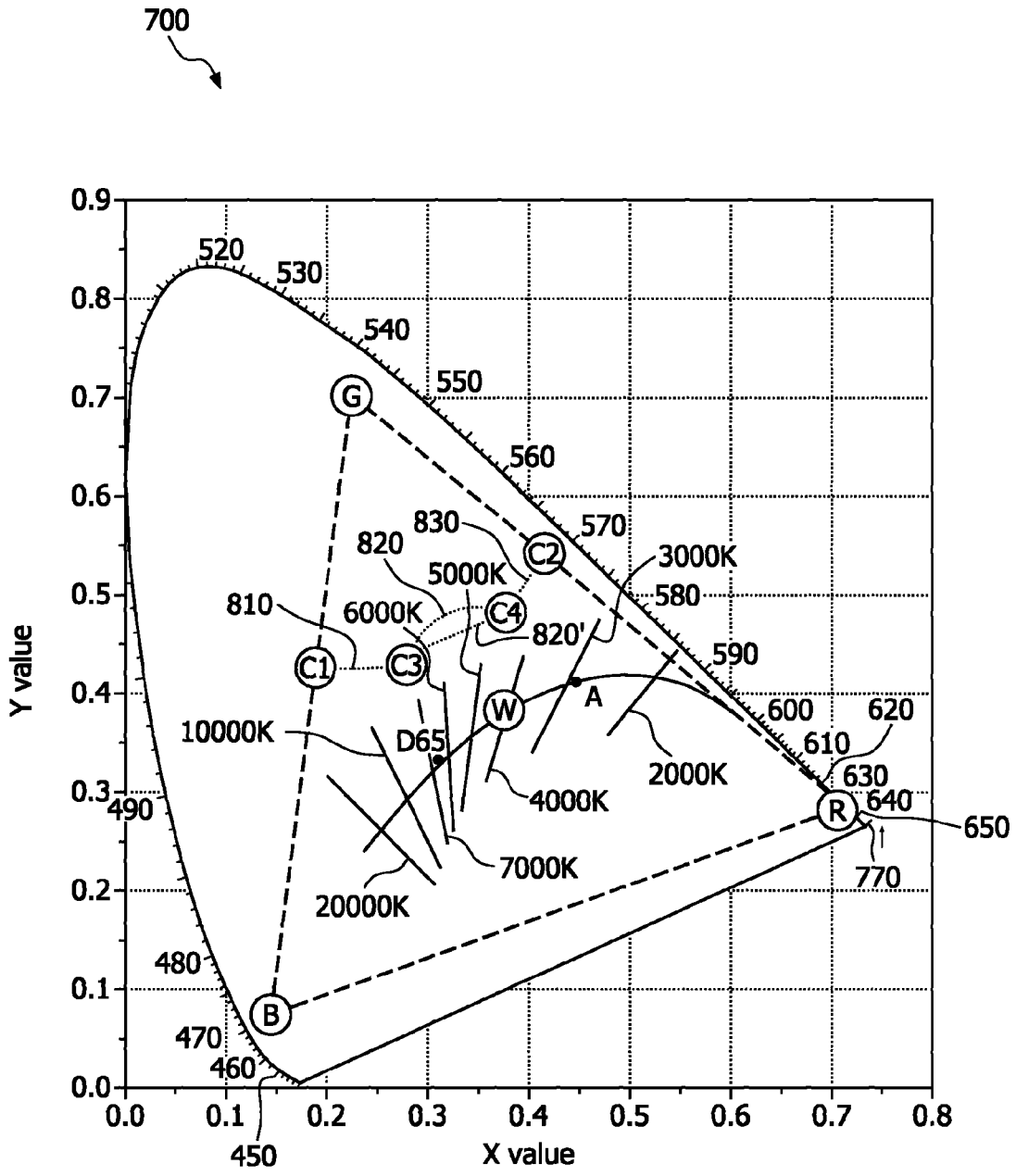
FIG. 7 shows an illustrative example of a color coordinate system according to a further embodiment.

FIG. 7 shows a color diagram in a color coordinate system 700 of the method 600 shown in FIG. 6 for the illustrative example of changing colors from an initial color C1 to a final color C2. The color change will follow the dotted paths 710, 720, 730 during the three phases 640, 650, 660, respectively. Instead of the dotted path 720, a different path 720' may be followed to change the color between the intermediate colors C3, C4, such as by differently varying the hue and/or saturation curves 670, 680 during the second phase 650.

Figure 8:
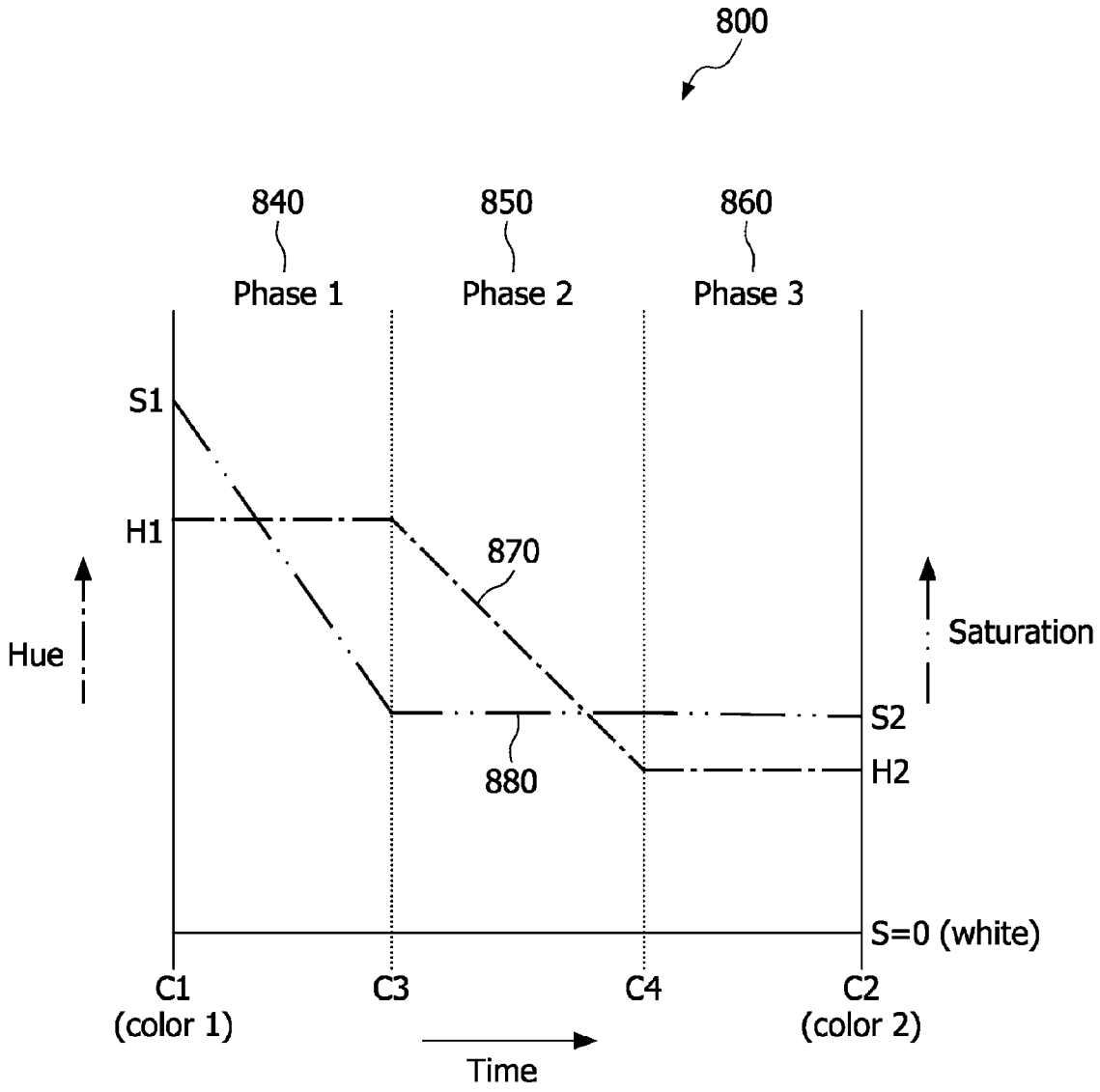
FIG. 8 shows another method according to another embodiment.

FIG. 8 shows yet another method 800 for the situation where the saturation of the starting color C1 or of the end color C2 is lower than the preferred minimum saturation value $S_{MIN}$ of the second phase, e.g., S2 is less than $S_{MIN}$, where $S_{MIN}$ is the preferred minimum saturation value in phase 2 as described in connection with the previous methods, e.g., typically 40% to 70% of the maximum value S1 and/or S2. As shown in the illustrative example of FIG. 8, when the final saturation value S2 is less then the preferred minimum saturation value $S_{MIN}$, then the saturation value in the second phase 850 is not reduced any further. Rather, the saturation value in the second phase 850 is set to equal the final saturation value of S2 of the third phase 860. Thus, the saturation value is kept constant at the low value of S2, being below $S_{MIN}$, during both the second and third phases 850, 860. In this illustrative method 800, the hue is changed along a hue cure 870 which is similar to the hue curve 270 described in connection with FIG. 2.

Of course, any other desired hue curve may be used in combination with further saturation curves, to dynamically and simultaneously control both the hue and saturation to provide a pleasing color change of light emanating from the controllable light source 920. That is, the controller or processor 930 may be configured to control the light source 920 to change the color of light emanating therefrom using any desired predetermined or programmable hue and saturation curves, which may be any combination of linear, exponential, parabolic, or other curves satisfying any polynomial equation, for example.

FIG. 9 shows a light control system 900 according to one embodiment where a user interface 910 allows for user input, e.g., to set the desired color and initiate control of the light source(s) 920 to change color and output light having the desired color. The light source 920 may be a table lamp or a projector that projects light to any desired area, such as a wall, ceiling, floor, an/or a corner of a room, for example. The light control system 900 may be applied in any color controlled lighting products, consumer electronics products, e.g., Ambilight™ televisions, domestic appliance products e.g., wake-up lamps; retail environment to provide desired lighting effects, and/or medical appliances and lighting, e.g., as applied in operation rooms, recovery rooms, emergency rooms and the like.

The light source 920 and user interface 910 are operationally coupled to a processor or controller 930 configured to receive an input, such as from the user interface 910 and in response, is configured to control at least one or more controllable light sources 920 to change color in accordance with one or a combination of the described methods, which may be stored as computer readable and executable instruction in a memory 940, operationally coupled to the processor or controller 930.

The user interface 910 may be, for example, located on the light source 920, on a hand-held remote controller, on a wall, and/or may be a soft switch such as displayed on a screen for control with any input device, such as a mouse or pointer in the case the screen is a touch sensitive screen. Further, touch sensitive elements (e.g., capacitively coupled strips or circular elements) of the user interface may be used to provide user input, such as to select the final or desired color along a color wheel, as well as to chose one of the various described methods, or combinations thereof, to change color.

The control system 900 may also be part of a master control system that may control various aspects of an environment, such as lighting, temperature, humidity, etc. Further, control system 900 may be configured to control any combination of light attributes such as intensity, color, color temperature, hue, diffuseness, focus, directivity, chromaticity, luminance, and/or saturation, in addition to changing the light color in accordance with codes stored in the memory 940 to perform any one or combination of the described methods. For example, various scripts of program codes may be stored in the memory for selection by the user to automatically change the color of light emanating from the light source 920 based on various predetermined or programmable parameters, such as time of day, day of week, the weather, season, etc., where appropriated sensors are providers, such as timers, calendars, photo-detectors to detect ambient light, temperature sensors, and the like.

The controller 930 may include any type of processor, controller, or control unit, for example. The controller or processor 930 is operationally coupled to controllable light source(s) 920, such as LEDs, for controlling and changing attributes of light emanating therefrom. Light emitting diodes (LEDs) are particularly well suited light sources to controllably provide light of varying attributes, as LEDs may easily be configured to provide light with changing colors, intensity, hue, saturation and other attributes, and typically have electronic drive circuitry for control and adjustment of the various light attributes. However, any controllable light source may be used that is capable of providing lights of various attributes, such as different colors, hues, saturation and the like, such as incandescent, fluorescent, halogen, or high intensity discharge (HID) light and the like, which may have a ballast or drivers for control of the various light attributes.

Further, the controller 930 includes or is operationally coupled to the memory 940. The memory 940 may be configured to store application data for proper operation of the controller 930 and other data, such as algorithm associated with the various hue and saturation curves according to the various described embodiments, and combinations thereof.

It should be understood that the various components of the lighting control system 900 may be interconnected through a bus, for example, or operationally coupled to each other by any type of link, including wired or wireless link(s), for example. Further, the controller 930 and memory 940 may be centralized or distributed among the various system components where, for example, multiple LED light sources 920 may each have their own controller and/or memory.

In another embodiment, the controller 930 is configured to select between a first method A and a second method B of going form the initial color to the final color based on how close are the hue values of the initial and final colors. For example, when the hue values of the colors in the starting and final scenes are not close, and the colors are saturated (like with LEDs), then changing the scene gradually from the starting scene to the final scene may cause a very colorful color change ('rainbow' like). All these intermediate colors have no meaning, neither for the starting scene nor for the final scene. Thus in this case, it is advantageous to use Method B for gradually changing the colors, where saturation is first decreased, hue changed and then saturation increased. However, in case the colors in the starting and final scenes are close, and the colors are saturated (like with LEDs), then changing the scene gradually from starting scene to final scene will cause a very smooth color change. Thus, Method A is sufficient and will be used where a direct or the shortest path between the initial and final colors or scenes is determined (e.g., by linear interpolation) and followed.

Figure 10:
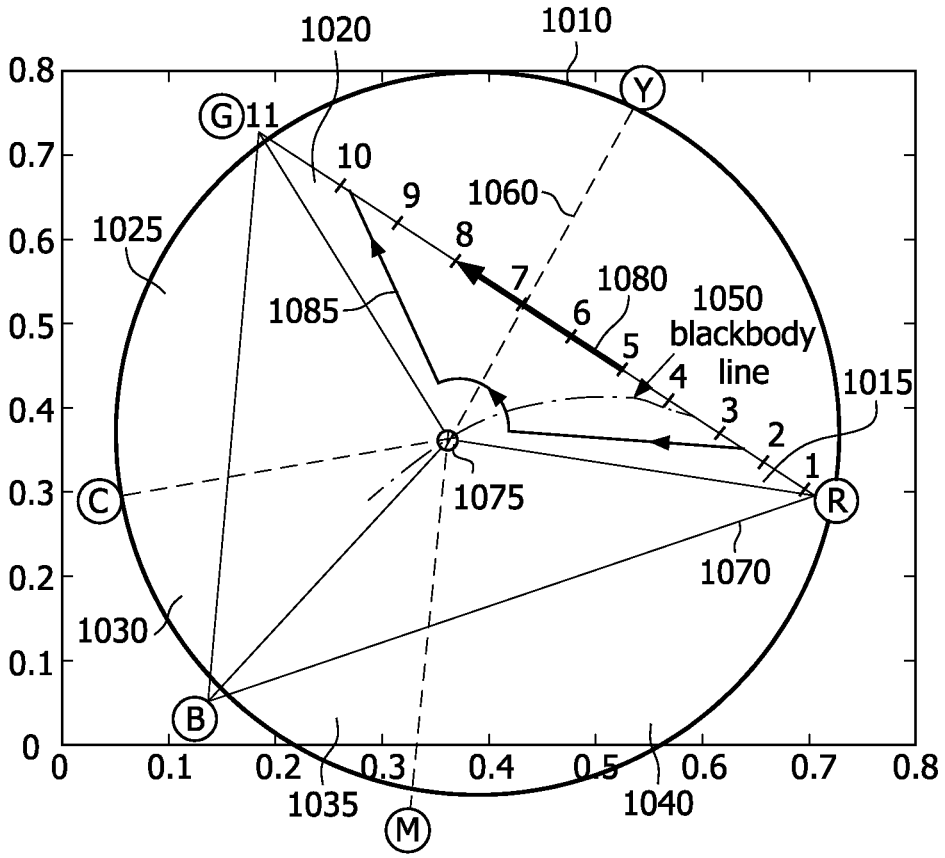
FIGS. 10-12 show color triangles in CIE1931 (x,y) space, and paths for changing color according to further embodiments.

Consider the color triangle for a RGB color mixing luminaire in CIE1931 (x,y) space. Its shape is determined by the primary colors Red (R), Green (G) and Blue (B) as shown in FIG. 10. It should be noted that a similar color space includes white (W), and the description related to the RGB space equally applies to the RGBW space using RGBW color mixing luminaires and the same or similar graphs or figures equally apply, where the white primary color is added to improve color rending quality (and W also defines the reference point 1075).

Figure 13:
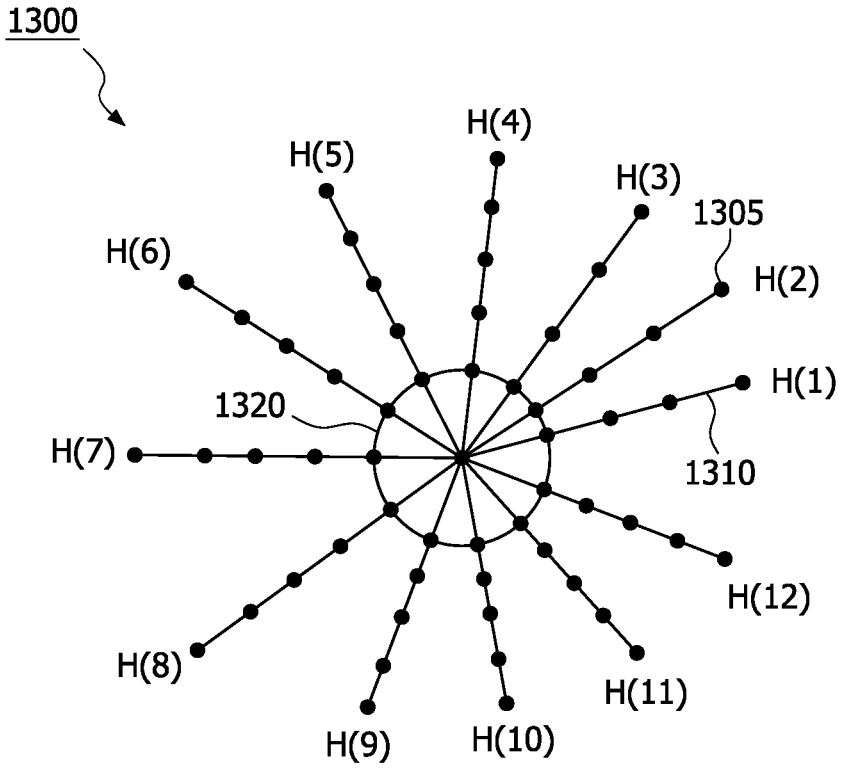
FIG. 13 shows a graphical representation of a color table according to another embodiment.

Consider a Hue, Saturation, Brightness (HSB) space, that includes a reference white point, e.g., point 1005 in FIG. 10 on or near the blackbody line 1050. Discrete Hue values are at different radial lines 1060 (or 1310 in FIG. 13) from the reference white point to a color on the color triangle 1070, for example. Further, as shown in FIG. 13 discrete Saturation values are shown as dots 1305 and are along a radial line 1310 (or 1060 in FIG. 10) in the color triangle 1070 through the reference white point and each of the defined Hue's along the color triangle. It should be noted that the Hue distribution need not be equidistant in the Hue angle definition of the CIE1931 (x,y) space. Further, it should be noted that the number of Saturation levels is not necessarily a constant that has for all Hue's the same value, neither it is necessarily a constant step size in CIE1931 (x,y) space. Of course, the brightness values are percentage of the maximum brightness in lumens that can be created at each color. Different hue values may by defined such as hue values that identify the colors yellow (Y), cyan (C) and magenta (M), as shown in FIG. 10.

It should be noted that Even if the HSB color space is not defined with a discrete table, but instead is defined with formulas or equations, for example, the control of a luminaire via a user interface will be usually discrete, with a discrete number of Hue, Saturation and Brightness steps. Change can easily be seen or measured using these discrete steps in color and intensity. There is also an end-user need for color changing steps to be discrete, e.g., to ensure that the light change after an action on the user interface (going from one hue to the next for example) is always a clearly visible change (feedback to the user). Otherwise the user may be confused and may not understand what is happening if the color change of light from a light source is too little or takes too long time before any effect is visible.

Discrete number of Hue steps are desirable as experienced (or measurable) by the user, when using a user interface of the color mixing luminaire. Since a product designer of a color mixing luminaire in general strives to have a more or less perceptual equal distribution of colors, controlled via discrete steps on the user interface device, using discrete hues and saturation values is desirable. Moreover, the fact that usually color mixing luminaires have a digital control of the light levels of the primaries colors means that any color change will be discrete by definition. As described, there are various methods to change from an initial to a final color or scene, which may be preset and stored in the memory 940 shown in FIG. 9.

In one embodiment, the controller 930 may be configured to select between two methods of changing colors, such as between Method A and Method B as will be described, based on closeness of initial and final hue values. In particular, initial and final hue values are close when they are located in adjacent segments of a color circle 1010 shown in FIG. 10. FIG. 10 shows the color circle 1010 or the color triangle 1070 being divided into six segments, where each segment has its own number of discrete hue values. Of course, instead of six segments, any number of segments may be used. FIG. 13 also shows a schematic graphical representation of a discrete Hue-Saturation table with twelve discrete radial or hue lines H(1)

to H(12), where each hue line H(i), i=1 to 12, has five discrete saturation values S(j), j=1 to 5, shown as dots 1305 along radial hue lines 1310. Each of the twelve radial hue lines 1310 represents a constant hue value.

Returning to FIG. 10, each segment of the six segments contains a part of the total range of the hue values and has its own number of discrete hue values where:

1. the first segment 1015 is between Red-Yellow (R-Y), with a number N_RY of Hue values, such as N_RY being seven RY hue values 1 to 7 shown in FIG. 10;

2. the second segment 1020 is between Yellow-Green (Y-G), with a number N_YG Hue values, such as N_YG being five YG hue values 7 to 11 shown in FIG. 10;

3. the third segment 1025 is between Green-Cyan (G-C), with a number N_GC Hue values;

4. the fourth segment 1030 is between Cyan-Blue (C-B), with a number N_CB Hue values;

5. the fifth segment 1035 is between Blue-Magenta (B-M), with a number N_BM Hue values;

6. the sixth segment 1040 is between Magenta-Red (M-R), with a number N_MR Hue values.

It should be noted that the segments may be the same or different size. For example, the six segments 1015, 1020, 1025, 1030, 1035, 1040 may be the same size by dividing the color circle 1010 into six equal segments. Of course, the color circle 1010 may be divided into any desired number of segments. Similarly, the number of hue points in each segment may be the same or different in the six segments, where in FIG. 10, the first and second segments 1015, 1020 have different number of hue points, namely, seven RY hue values (1 through 7) in the first segment (i.e., RY segment) 1015, and five YG hue values (7 through 11) in the second segment (i.e., YG segment) 1020.

In a first case, when the initial and final hue values are not in adjacent or neighboring segments, then they are deemed to be far, or not close, and thus the controller 930 selects method B. Method B comprises indirectly going from the initial to final colors through an intermediate color or reference white point 1075, which may be any point substantially on or near a blackbody line 1050. For example, using method B, saturation of the initial color, e.g., Red having a first or initial hue value $H_1$ and a first or initial saturation value $S_1$, is decreased from to $S_1$ to $S_{min}$, where $S_{min}$ is the saturation value of the intermediate color or reference point 1075 (e.g., substantially on or near a blackbody line 1050) which may be substantially white and $S_{min}$ may be substantially zero.

Figure 11:
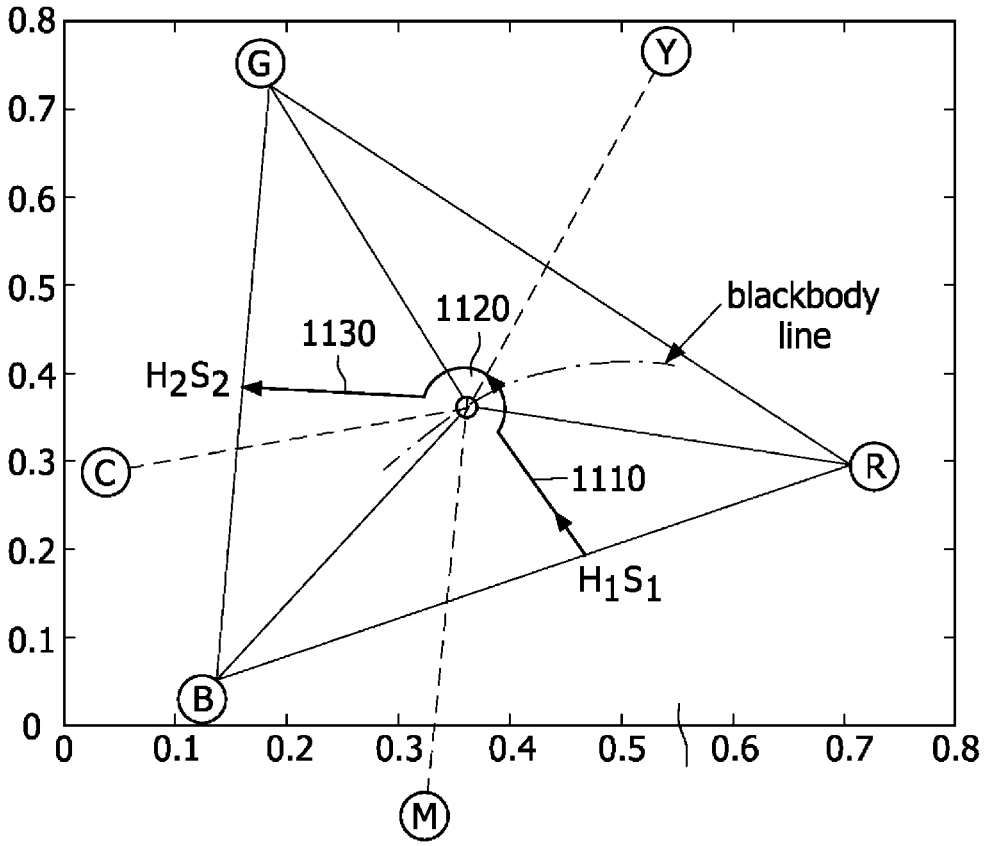

Of course, the saturation may be decreased to a lower value possibly near zero, instead of zero, as shown in FIG. 11, where the initial saturation $S_1$ of an initial color (having initial hue and saturation $H_1S_1$) is first decreased along path 1110 to an intermediate value $S_{min}$ to a first intermediate point $H_1S_{min}$, then the hue is changed along path 1120 (where the saturation remains as the intermediate value $S_{min}$) from the initial hue value $H_1$ to the final hue value $H_2$, where a second intermediate point is reached $H_2S_{min}$. Next, the saturation is increased along path 1130 from the intermediate value $S_{min}$ to the final saturation value $S_2$ thus reaching the final color having the final hue and saturation values $H_2S_2$.

Figure 12:
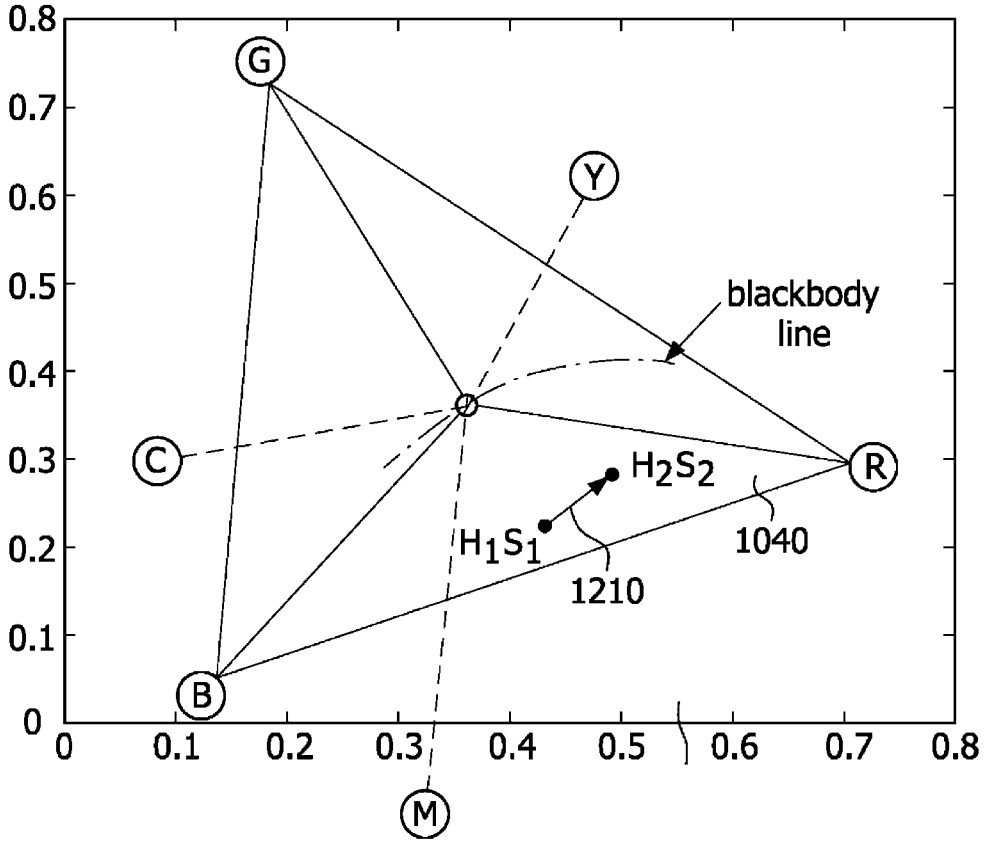

In a second case, when the initial and final hue values are in the same segment, then they are deemed to be close, and thus the controller 930 selects method A, where the initial color is changed to the final color directly, such as using linear interpolation to go directly from the initial color to the final color, as shown by the direct path 1210 in FIG. 12 between initial and final colors $H_1S_1$, $H_2S_2$, which are in the sixth segment M-R 1040.

In a third case, when the initial and final hue values are in adjacent or neighboring segments, then the distance a hue distance HD between the initial and final hue values is determined, and the controller 930 selects method A or B based on the determined value of the hue distance HD. In particular, the hue distance HD is defined as the number of discrete hue values, or the minimum number of steps in a discrete Hue table to incrementally step from the initial hue value $H_1$ to the final hue value $H_1$ of the initial and final colors.

FIG. 13 shows a graphical representation 1300 of a color table that may be stored in the memory 940 (shown in FIG. 9) having a fixed or discrete number of hue and saturation values or steps, which may be any desired number hue and saturation values (independent of brightness). In FIG. 13, the number of hue values is twelve, namely H(1) to H(12). That is, the color circle 1010 shown in FIG. 10 is divided into radial lines 1310, where each line represents a particular hue value, where twelve lines or discrete hue values are shown in FIG. 13. The hue values may be grouped into segments containing an equal or different number of hue values, such as the six segments shown in FIGS. 10-12, for example. That is, a segment is a group of adjacent hue values, being a part of the full color circle.

Further, FIG. 13 shows that each hue value H(1) to H(12) has five saturation value shown as five dots (including the center dot) along a radial line 1310. The various radial lines may have the same number or a different number of saturation values or steps. Circle 1320 is shown in FIG. 13 having the same saturation value. Another color table may include 30 hue values (NHue=30) and 10 saturation values (NSat=10), where each color is defined by Hue (i) with i=1 . . . 30, and Sat(j) with j=1 . . . 10. One can change color from an initial color having values [Hue(3), Sat(5)] to a final color [Hue(10), Sat(10)], for example.

N1 and N2 are also defined as follows, (which are in addition to defining the hue distance HD as the minimum number of steps or hue values in a hue-saturation table (similar to that shown in FIG. 13) to incrementally step from the initial hue value $H_1$ to the final hue value $H_2$):

N1 is the number of hue values in the segment of the color circle that includes the initial hue value $H_1$ (e.g., being one of the 6 segments shown in FIG. 10), and similarly N2 is the number of hue values in the segment of the color circle that includes the final hue value $H_2$.

The initial and final hue values $H_1$, $H_2$ are defined as being close when:

$HD \leqq \alpha\,(N1+N2)$ for hues in the first and second neighboring segments;

with $0<\alpha<1$, where it may be desirable to set $\alpha=0.5$ or smaller.

It should be noted that the hue distance HD may be defined with further constants that may be selected to have any desired value. For example, the following relationship may be used for the hue distance HD:

$$HD=\alpha N1+\beta N2+\gamma(N1)(N2)+\Delta$$

where $\alpha$, $\beta$, $\gamma$, $\Delta$ are all constants that are set to a desired value, e.g., by the user. The above general formula for the hue distance HD is reduced to the one described above when $\alpha=\beta$ and $\gamma=\Delta=0$. Of course, if desired, upper and lower limits may be pre-set for the values of one or more of the constants $\alpha$, $\beta$, $\gamma$, $\Delta$ so that a user cannot set the value(s) of the constant(s) beyond such maximum and minimum values.

In an illustrative example shown in FIG. 10, assume the initial hue value H1 is inside the R-Y segment 1015, where $H_1=5$ (or $H_1$=H(5)), and the final hue value $H_2$ is in the adjacent or neighboring Y-G segment 1020, where $H_2=8$ (or H2=H(8)). The hue distance HD, which is the number of hue steps from $H_1$ to $H_2$ is 8-5=3. N1=7 since there are 7 hue value in the R-Y segment 1015, namely H(1) to H(7), and N2=5 since there are 5 hue value in the Y-G segment 1020, namely H(7) to H(11). Let $\alpha$=0.5, so $\alpha$ (N1+N2)=0.5 (7+5)=6. Since HD≦$\alpha$ (N1+N2) or 3≦6, then the two colors or hues H(5) and H(7) are close and Method A is selected and a direct linear path 1080 is followed. If HD>6, then the initial and final hue values are not close, and Method B is selected and path 1085 is followed.

It should be noted that in addition or instead of using a fixed value for a for all combinations of 2 colors in the color transition from an initial Color 1 to a final Color 2 (Color being defined as a combination of Hue and Saturation values HS), a table may be used that includes factors a defined per combination of the initial and final hue values $H_1$, $H_2$, or even per $H_1$ and $H_2$ values together with their associated initial and final saturation values $S_1$ and $S_2$.

It should also be noted that it is desirable to have a minimum value for $\alpha$, as seen from the following example. If a is approximately zero, then initial and final color are deemed close if the hue distance between them HD≦$\alpha$ (N1+N2) or HD less than or equal to almost zero, when a is approximately zero. In most cases, this means that the color cannot gradually change from the one segment to the next segment. Consider the example shown in FIG. 10, where the first segment 1015 between Red-Yellow has 7 hues values 1 through 7, and the second segment 1020 between Yellow-Green has 4 hue values from 7 to 11.

If $\alpha$=0.1, then a (N1+N2)=0.1(7+4)=1.1

This means that two colors are close only if there distance is less than or equal to 1.1. That is, only colors that are next to each other are deemed close, e.g., $H_2$ and $H_3$, where $H_2$ and $H_4$ are deemed far since the distance between them is 2 (i.e., HD=2) and based on the formula, HD≦$\alpha$ (N1+N2), then 2>1.1 and thus $H_2$ and $H_4$ are deemed to be far apart despite being in the same segment, namely, the first segment 1015. Of course, such a criteria, where only adjacent colors are deemed to be close, is too restrictive. Therefore, it is desirable to set a lower boundary or value for a that should substantially always lead to having an initial color in the one segment (e.g., the first segment 1015) and the final color in the adjacent segment (e.g., the second segment 1020). Such a lower boundary for a may be determined experimentally, for example, depending on the particular situation, such as the number of segments, the number of hue points in each segment, and the like.

For hue values that are close according to the above definition, i.e., when the hue distance HD between initial and final hue values $H_1$, $H_2$ satisfies HD≦$\alpha$ (N1+N2), then method A is used during a color change (e.g., linear interpolation directly) between the initial and final colors; otherwise method B is used.

A system and a controller that automatically select between methods A and B as described (e.g., depending on the hue distance HD between the starting point Hue and the end point Hue between which the colors are gradually changed,) allows for a user friendly and gradual change between two colors or presets that may stored in the memory 940 shown in FIG. 9, thus easily fine-tune the atmosphere between the two pre-sets.

Of course, as it would be apparent to one skilled in the art of communication in view of the present description, various elements may be included in the system or network components for communication, such as transmitters, receivers, or transceivers, antennas, modulators, demodulators, converters, duplexers, filters, multiplexers etc. The communication or links among the various system components may be by any means, such as wired or wireless for example. The system elements may be separate or integrated together, such as with the processor. As is well-known, the processor executes instruction stored in the memory, for example, which may also store other data, such as predetermined or programmable settings related to system control.

Various modifications may also be provided as recognized by those skilled in the art in view of the description herein. The operation acts of the present methods are particularly suited to be carried out by a computer software program. The application data and other data are received by the controller or processor for configuring it to perform operation acts in accordance with the present systems and methods. Such software, application data as well as other data may of course be embodied in a computer-readable medium, such as an integrated chip, a peripheral device or memory, such as the memory 940 or other memory coupled to the processor 930.

The computer-readable medium and/or memory may be any recordable medium (e.g., RAM, ROM, removable memory, CD-ROM, hard drives, DVD, floppy disks or memory cards) or may be a transmission medium (e.g., a network comprising fiber-optics, the world-wide web, cables, and/or a wireless channel using, for example, time-division multiple access, code-division multiple access, or other wireless communication systems). Any medium known or developed that can store information suitable for use with a computer system may be used as the computer-readable medium and/or memory.

Additional memories may also be used. The computer-readable medium, the memory, and/or any other memories may be long-term, short-term, or a combination of long-and-short term memories. These memories configure the processor/controller to implement the methods, operational acts, and functions disclosed herein. The memories may be distributed or local and the processor, where additional processors may be provided, may be distributed or singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network, such as the Internet, is still within memory, for instance, because the processor may retrieve the information from the network.

The controllers/processors and the memories may be any type. The processor may be capable of performing the various described operations and executing instructions stored in the memory. The processor may be an application-specific or general-use integrated circuit(s). Further, the processor may be a dedicated processor for performing in accordance with the present system or may be a general-purpose processor wherein only one of many functions operates for performing in accordance with the present system. The processor may operate utilizing a program portion, multiple program segments, or may be a hardware device utilizing a dedicated or multi-purpose integrated circuit. Each of the above systems utilized for changing color may be utilized in conjunction with further systems.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same or different item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts or steps is intended to be required unless specifically indicated; and i) the term "plurality of" an element includes two or more of the claimed element, and does not imply any particular range of number of elements; that is, a plurality of elements may be as few as two elements, and may include an immeasurable number of elements.

The invention claimed is:

1. A lighting system, comprising:

a light source configured to provide a light;

a user interface for receiving a user input related to a desired final color of the light; and a controller for controlling at least hue and saturation of the light to change a color of the light along a predetermined path in at least two phases from an initial color going through an intermediate color having reduced saturation relative to the initial color to the final color, wherein, during a first phase, the controller is adapted to reduce the saturation to reach the level of the intermediate color while maintaining the hue at an initial value, and during at least a second phase, the controller is adapted to modify the hue from the initial value to a final value and maintain saturation at the intermediate color to set to the level of provided light to the final color.

2. The light system of claim 1, wherein, during a third phase after the second phase, the controller increases the saturation from the intermediate level to a final level and changes the hue from the initial value to a final value.

3. The light system of claim 1, wherein the controller is configured to change the saturation during one phase while keeping the hue constant, and to change the hue in another phase while keeping the saturation constant.

4. The light system of claim 3, wherein the controller is configured to change the saturation at a slower rate near at least one of an initial setting and a final setting relative to a rate of change near an intermediate setting between the initial setting and the final setting.

5. The light system of claim 1, wherein the controller is configured to simultaneously change the saturation while maintaining constant the hue during an initial phase and a final phase, and to simultaneously change the hue while maintaining constant the saturation during an intermediate phase.

6. A method of controlling a light source, comprising;

producing a light from the light source;

receiving a user input related to a final color; and controlling hue and saturation of the light to change a color of the light automatically along a predetermined path from an initial color going through an intermediate color having reduced saturation relative to the initial color to a final color during at least two phases, wherein, during a first phase, the saturation is reduced from the initial level to reach and intermediate level to reach the level of the intermediate color while maintaining the hue at an initial value, and in a second phase, maintaining the saturation at the intermediate level and change the hue from the initial value to a final value to set to the light output level at the final color.

7. The method of claim 6, wherein, during a third phase, the controlling act increases the saturation from the intermediate level to a final level and changes the hue from the initial value to a final value.

8. The method of claim 6, wherein the controlling act changes the saturation during one phase while keeping the hue constant and changes the hue in another phase while keeping the saturation constant.

9. The method of claim 8, wherein the controlling act changes the saturation at a slower rate near at least one of an initial setting and a final setting relative to a rate of change near an intermediate setting between the initial setting and the final setting.

10. The method of claim 6, wherein the controlling act simultaneously changes the saturation while maintaining constant the hue during an initial phase (440) and a final phase (460), and changes the hue while maintaining constant the saturation during an intermediate phase (450).

11. The method of claim 6, wherein, in response to a desired setting that includes a saturation level which is below a predetermined level, the controlling act reduces the saturation to the predetermined level during a first phase and maintains constant the saturation at the predetermined level during a second phase.

* * * * *